US009242450B2

(12) United States Patent
Noricks

(10) Patent No.: US 9,242,450 B2
(45) Date of Patent: Jan. 26, 2016

(54) SEAT BELT THERMAL GRAPHICS APPLICATION DEVICE

(71) Applicant: Jason George Noricks, Sacramento, CA (US)

(72) Inventor: Jason George Noricks, Sacramento, CA (US)

( * ) Notice: Subject to any disclaimer, the term of this patent is extended or adjusted under 35 U.S.C. 154(b) by 0 days.

(21) Appl. No.: 14/278,939

(22) Filed: May 15, 2014

(65) Prior Publication Data

US 2015/0013557 A1 Jan. 15, 2015

Related U.S. Application Data

(60) Provisional application No. 61/830,015, filed on May 31, 2013.

(51) Int. Cl.

| | |
|---|---|
| ***B41F 16/00*** | (2006.01) |
| ***B41M 5/00*** | (2006.01) |
| ***B44C 1/17*** | (2006.01) |
| ***B41M 5/025*** | (2006.01) |

(52) U.S. Cl.

CPC ..... *B41F 16/0046* (2013.01); *B41M 5/025* (2013.01); *B44C 1/17* (2013.01); *B44C 1/1712* (2013.01)

(58) Field of Classification Search

CPC .... B41F 16/006; B41F 16/0046; B41F 16/02; B41F 16/00; B41M 5/0256; B41M 5/025; B41M 5/011; B41M 5/0358; B44C 1/00; B44C 1/162; B44C 1/1729; B44C 1/1712

See application file for complete search history.

(56) References Cited

U.S. PATENT DOCUMENTS

| | | | | |
|---|---|---|---|---|
| 3,783,073 | A * | 1/1974 | Warnberg | 156/230 |
| 4,379,018 | A * | 4/1983 | Griesdorn | 156/359 |
| 4,943,684 | A * | 7/1990 | Kramer | 428/34.4 |
| 5,170,704 | A * | 12/1992 | Warren et al. | 101/41 |
| 5,643,387 | A * | 7/1997 | Berghauser et al. | 156/230 |
| 6,053,178 | A * | 4/2000 | Todd | 132/208 |
| 6,186,207 | B1 * | 2/2001 | Berghauser et al. | 156/384 |

* cited by examiner

*Primary Examiner* — Matthew G Marini
*Assistant Examiner* — Leo T Hinze
(74) *Attorney, Agent, or Firm* — Murray Tech Law; Kenneth A. Murray; Jay S. Jongjitirat

(57) ABSTRACT

An apparatus and method for thermally applying and removing a graphic to and from seat-belt webbing, the apparatus comprising a housing with an engagement slot to receive the seat-belt webbing and a graphic thermal coupon. The apparatus and graphic coupon useable without removing the seat belt webbing from the vehicle. The apparatus further useable while an occupant is seated with the seat belt fully engaged to allow the graphic coupon to be optimally positioned on the seat belt. The thermal graphic coupon comprising three layers including a heat transfer layer, a graphic membrane layer and an adhesive protective layer. The graphic membrane layer includes a graphic image that is actively applied to the seat belt webbing at specified temperatures without compromising the integrity of the seat belt webbing. The graphic is removed by reversing the process using a release sheet that preferentially absorbs the graphic membrane when reheated.

6 Claims, 13 Drawing Sheets

SEAT BELT THERMAL GRAPHICS APPLICATION DEVICE

CROSS-REFERENCE TO RELATED APPLICATIONS

This application claims the benefit of U.S. Provisional Application No. 61/830,015 entitled "Seat Belt Thermal Graphics Application Device," filed May 31, 2013.

TECHNICAL FIELD

The present invention generally relates to an apparatus and method for thermally applying and removing graphics to belts. More particularly, the invention relates to such an apparatus and method for thermally applying and removing graphics to vehicle seat belts and other similar webbed belts.

BACKGROUND

In today's race for expression of individualism through an individual's automobile or other vehicle, preferences are expressed through many different forms of enhancement and decoration. These expressions have boasted alumni messages, sports team preference, home state messages and many other similar messages for which individuals have a fondness or personal association therewith and wish to make these preferences known to the public at-large. Frequently, for families with children, this expression may simply be targeted toward creating a positive environment for each child to allow travel in the vehicle to be more attractive and less boring. One example of this expression is the application of labels to windows near the child reflecting a theme of interest.

These individualistic or community messages come in a variety of forms such as bumper stickers or decals applied to the windows of vehicles. They may also come in the form of "vanity" license plates. In addition, expression can be added via the use of seat belt pads that are wrapped around the seat belt and may have various logos and other graphics.

Since people spend a great deal of time in their cars, many tend to treat their car as an extension of their personality. In addition to the types of cars they drive, people often add personalization, as indicated above, to express their beliefs, associations, and tastes to other drivers of the motoring public, passersby, and to other passengers that might occupy the vehicle.

Just as vehicle personalization has experienced growth in recent times, there has likewise been considerable growth in the industry devoted to consumer-personalization of clothing items, such as T-shirts, sportswear and the like. The creation of such personalized items typically takes place using either one of two different techniques, namely, by directly printing a personalized image onto the article of clothing or by printing an image onto a transfer sheet and then transferring the printed image from the transfer sheet to the intended article using heat and pressure. Consumer-personalization via direct printing is typically performed in specialty shops as a "do-it-for-you" approach. According to this approach, a consumer, using an e-commerce web server, sends the print shop a graphic image in digital format, together with information on the selected type, color and size of clothing article. The shop then electronically transforms the graphic image into a standard graphic format and subsequently transmits the formatted image to a direct-to-fabric industrial printer for a final printing. Before shipping the personalized item to the consumer, the shop may use heat-pressing to further fix the image on the article of clothing.

The second method, personalization via image transfer, typically involves the use of a heat transfer sheet as an intermediate holder of a graphic image. The image transfer technique enables consumer-personalization to be performed not only by specialized shops but also by the individual consumer using common household articles, such as a desktop, ink-jet printer for printing and an iron for heat-transfer. Background information relating to the image transfer technique may be found in the following illustrative patents and published patent applications, all of which are incorporated herein by reference: U.S. Pat. No. 7,160,411, inventors Williams et al., which issued Jan. 9, 2007; U.S. Patent Application Publication No. US 2006/0172094 A1, inventors Shi et al., which was published Aug. 3, 2006; U.S. Pat. No. 6,139,672, inventors Sato et al., which issued Oct. 31, 2000; U.S. Pat. No. 4,773,953, inventor Hare, which issued Sep. 27, 1988; and U.S. Pat. No. 4,294,641, inventors Reed et al., which issued Oct. 13, 1981.

The graphic image applied to a heat-transfer sheet may be printed using analog printing techniques or digital printing techniques. Examples of suitable analog printing techniques include letterpress, flexography, gravure, reverse gravure, offset lithography (wet and dry), flat and rotary screen, hot and cold stamping, pens and markers. Such techniques are capable of applying a thick, mechanically durable, graphic image. Examples of suitable digital printing techniques include using common desktop and wide format shop printers, such as ink-jet, toner-based laser, ion or electron charge deposition printing, copy machines, phaser and direct thermal or thermal transfer printers, etc. In general, digital printing techniques result in a much smaller amount of ink or toner being printed. Consequently, if a digital printing technique is used, the transfer sheet typically includes a polymer-based meltable coating (as opposed to lacking such a coating and having the image printed directly on the non-transferable support) as such a coating is used to absorb or to hold in place the graphic image. In certain instances, a combination of both analog and digital printing techniques may be used on a heat-transfer sheet. Despite the growth in using heat transfer sheets for personalization of clothing and other items, the rather permanent nature of components within a vehicle has prevented the use of this technique for personalizing components within a vehicle.

There is a significant existing market for decorative items associated with automobiles and trucks. The estimated 2013 market in the US alone for aftermarket decorative items for automobiles is approximately $234 billion according to the Automotive Aftermarket Industry Association. Despite this massive market opportunity, since the advent of seatbelts in vehicles for safety purposes, little has been done to enhance or personalize the appearance of seat belts. To date, the only two methods known for applying decorative components to seatbelts include either seatbelt pads that wrap around the seat belt and are joined with Velcro, or, labels that are actually sewn to the seat belt.

The first personalization method, seatbelt pad, detracts from the streamlined appearance of a seat belt and may interfere with operation of the seat belt. The second quasi-personalization method using sewn labels really does not constitute a method that can be used by the owner of the vehicle. Additionally, sewn labels may impair the integrity of the seat belt and take significant time to attach. Additionally, sewn seat belts generally have labels applied at the manufacturer. Consequently, a consumer would not use the method of sewn attachment to apply decorative graphics to a seat belt. As a result, a consumer is generally limited to only one method of enhancing appearance of seat belts, which is the use of seat belt pads. A purist vehicle enthusiast is likely to reject the use of seat belt pads for personalization for many reasons, including a realization that a seat belt pad is not an "original" piece of equipment associated with the vehicle.

However, for those interested in further enhancing personal expression within the context of their vehicle, the ability to personalize seat belts would clearly be very desirable for a plurality of different reasons.

SUMMARY

An apparatus and method for thermally applying and removing a graphic to and from seat-belt webbing, the apparatus comprising a housing with an engagement slot to simultaneously receive the seat-belt webbing and a thermal graphic coupon. The apparatus and graphic coupon are useable without removing the seat belt webbing from the vehicle. The apparatus is further useable while an occupant is secured in his or her seat with the seat belt fully engaged to allow the graphic coupon to be optimally positioned on the seat belt. The thermal graphic coupon comprises three primary layers or sheets adapted to support the method according to the invention. The primary layers or sheets include a heat transfer sheet, a graphic membrane layer and an adhesive protective sheet.

The heat transfer sheet is the top layer of the thermal graphic coupon and serves multiple purposes. First, the heat transfer sheet includes a duplicate of the image to be thermally transferred to the seat belt, printed on the top of the heat transfer sheet. Provision of this image allows a user to quickly and easily select the preferred graphic coupon for application. In addition, the heat transfer sheet serves as an intermediate barrier between the heating platen of the apparatus and the graphic membrane layer, which is ultimately transferred to the seat belt. Lastly, the heat transfer sheet remains affixed to the graphic membrane layer until the graphic membrane layer has cooled to ambient temperature, providing a protective sheet while cooling. Once the seat belt webbing and graphic membrane layer have cooled sufficiently, the user can easily peel the heat transfer sheet off the graphic membrane layer while the graphic membrane layer remains affixed to the seat belt webbing.

The second sheet in the thermal graphic coupon is the graphic membrane layer which includes a thermally applicable and transferable graphic image that is transferred to the seat belt webbing using heat and pressure at specified temperatures without compromising the integrity of the seat belt webbing. The graphic membrane layer includes an adhesive film on its seat belt facing side that allows one to optimally position the graphic coupon on the seat belt webbing prior to thermal transfer.

The third sheet is a protective cover applied to the back of the graphic coupon to prevent the sticky adhesive from becoming contaminated. The protective sheet is removed to allow a user to position and stick the graphic coupon to the seat belt webbing for thermal application.

Although not discussed herein as an element of the thermal graphic coupon, the apparatus and method further includes a release sheet that is used for removal of the graphic from the seat belt webbing. The release sheet is applied over the graphic image on the seat belt webbing and then the release sheet and seat belt webbing are heated to a predetermined release temperature and sufficient pressure is applied to cause the graphic membrane layer to be preferentially absorbed into the release sheet and off the seat belt webbing.

It is an object of the invention described herein to provide an apparatus and method for thermal application and removal of a fabric or paper-based graphic coupon, such as a patch, to a seatbelt previously installed within a car, van, bus, airplane, train or other vehicle, while ensuring that the coupon can be thermally applied without impairing the integrity of the seat belt and jeopardizing the safety of occupants secured by the seat belts.

The apparatus according to the invention allows thermal application of a graphic to seatbelt webbing wherein the heating element of the apparatus further includes an automatic shut off to prevent over application of heat to avoid damage or impairment to the seatbelt webbing. The heating element includes a controllable heating component that allows temperature and heating duration to be chosen to accommodate different types of graphic coupons and different types of seat belt webbing fabric and material.

The apparatus and method further includes a process wherein the graphic can be optimally positioned and then easily applied to the seat belt in the optimal position using an adhesive sticky film. The application of the graphic coupon to the seat belt webbing followed by slidably positioning of the belt and applied graphic within the clamping area of the apparatus provides a method by which the graphic can be applied in an optimal position.

The apparatus and method described herein provide several advantageous features. First, one does not need to remove the seatbelt from the vehicle to apply decorative or personalized graphics. Further, to support optimal positioning of the graphic on the belt, the apparatus and method can be used with a passenger actually buckled in the seat. Additionally, the apparatus supports the application of one or more graphics in rapid succession. Further, the apparatus and method thermally applies graphics in a manner that does not compromise the integrity of the seat belt webbing. Still further, the method and apparatus ensures that applied graphics do not change the thickness or smoothness of the belt in any manner that might impede optimal operation of the seatbelt assembly, including the retractors.

In addition to ease in application of desired graphics, the method and apparatus further supports simplistic yet effective removal of the thermally-applied graphics. Removal is generally accomplished by reversing the application procedure but using a specific removal membrane, hereinafter, designated a "release sheet" that preferentially releases and absorbs the graphic from the seat belt for removal.

Simple removal of the graphic after application is a very desirable feature. For example, if a vehicle owner decides to sell his or her vehicle, the applied graphics can be removed to place the vehicle in more original condition. This avoids the possibility that a potential purchaser's tastes would be offended by the seller's tastes and preferences. Additionally, as children grow, their tastes change. Hence, the graphics of interest to a younger vehicle occupant would be very different from an older occupant. Further, the vehicle owner may change loyalties regarding sports teams, schools, political parties and other associations, causes or movements wherein the vehicle owner elects to change the graphics on the seat belts.

BRIEF DESCRIPTION OF THE DRAWINGS

For a more complete understanding of the present invention, reference is made to the detailed description contained herein and the accompanying drawings numbered below which are given by way of illustration only and are not intended to be limitative to any extent. Commonly used reference numbers identify the same or equivalent parts of the claimed invention throughout the several figures. Now, therefore:

DETAILED DESCRIPTION

Figure 1A:
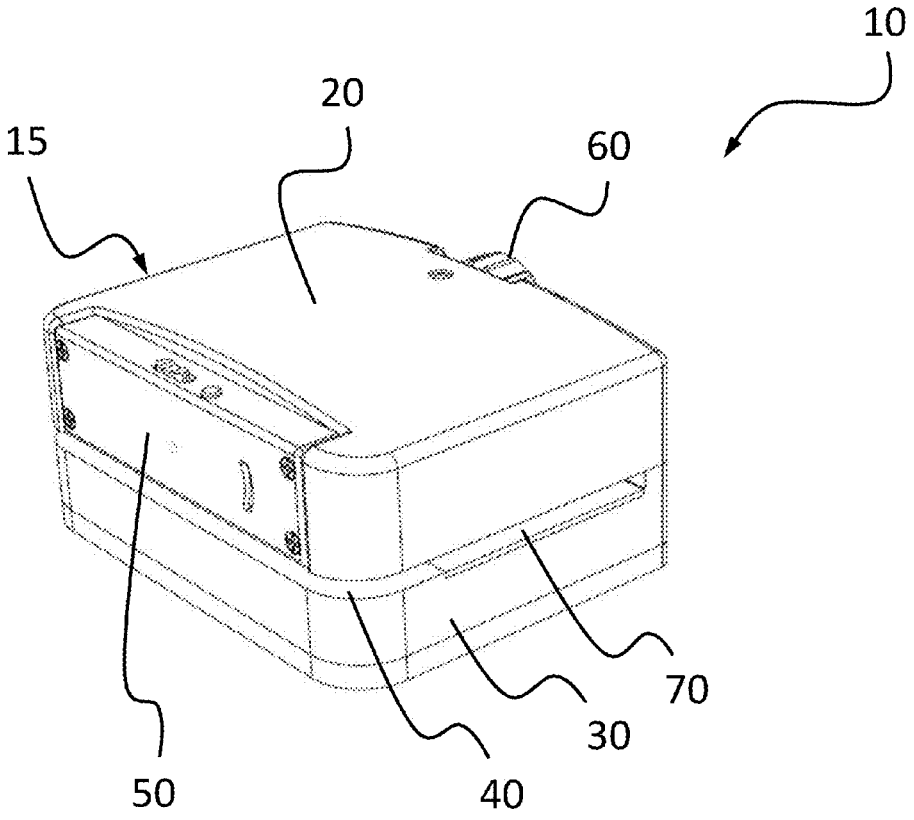
FIG. 1A is a first perspective view of an embodiment of the apparatus according to the teachings of the present invention.

For purposes of the present specification and claims, it is to be understood that certain terms used herein, such as "on" or "over," when used to denote the relative positions of elements in a heat-transfer sheet, are primarily used to denote such relative positions in the context of how those elements are situated prior to transfer of the transfer portion of the sheet onto an article since, after transfer, the positions of those elements may be reversed or otherwise differ.

Objects, features, advantages and aspects of the present invention, will be set forth in part in the description which follows, and in part will be obvious from the description or may be learned by practice of the invention. In the description, reference is made to the accompanying drawings which form a part thereof and in which is shown by way of illustration a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense.

Although the discussion herein is primarily directed to personalization or ornamentation of webbed seat belts associated with automobiles and trucks, similar opportunities for personalization are encountered in other scenarios where standard seat belt webbing is used, e.g., aircraft, buses, safety harnesses, bag straps, tie-downs, etc. In particular, the apparatus and method described herein has the opportunity to create a new form of advertising and branding in many transportation industries. For example, in one aspect, an airline could elect to sell advertising space on the seatbelts used within the airplane. The ability to quickly and easily apply and remove various graphics from each seat belt allows the airline to generate additional add revenue and promote either its own brand or the brand of others. Still further, the apparatus and method described herein can be used to apply graphics to the shoulder straps of a backpack. This form of branding and personalization would be very desirable for students and parents of all ages who have a desire to personalize a backpack. For example, in one aspect, an applied graphic could simply be the student's phone number or other relevant information.

For effective use of the thermal application method described herein, it is essential to consider the material from which a seat belt is made and the various regulatory requirements associated with seat belts. For example, seat belt webbing has certain characteristics and specifications driven by various safety regulations such as those promulgated by the U.S. Department of Transportation (US DOT). For example, in §571.209 Standard No. 209; Seat belt assemblies, the US DOT requires that width of the webbing in a seat belt assembly shall be not less than 46 mm. Additionally, any aftermarket enhancement would need to ensure that the integrity of the seat belt is not impaired. Consequently, considering potential liability associated with failure of a seat belt during a collision due to subsequent personalization, one can understand why there has been little if any motivation to develop methods for applying graphics to seat belts.

Figure 1B:
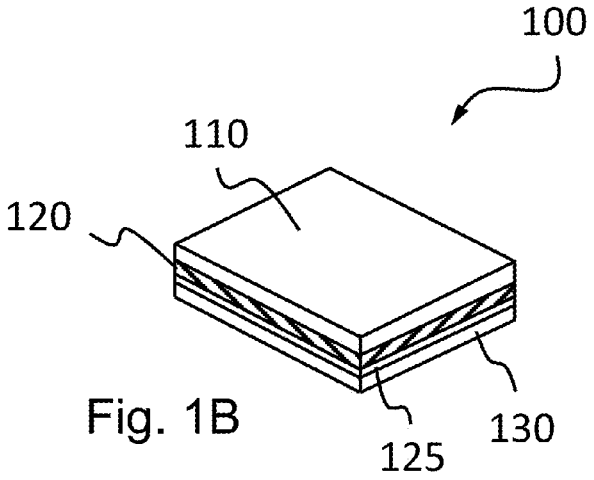
FIG. 1B is a perspective view of a thermal graphic coupon.

Now, referring to FIGS. 1A and 1B, a perspective view of an embodiment of the apparatus 10 and a corresponding thermal graphic coupon 100 is shown. The apparatus 10 is designed to slidably receive seat belt webbing and a thermal graphic coupon 100 within engagement slot 40 of the apparatus 10 for application of a desired graphic to seat belt webbing. In one embodiment, the apparatus 10 includes a housing 15 comprised of an upper housing portion 20 and a lower housing portion 30.

Upper housing portion 20 and lower housing portion 30 are joined and thereby form engagement slot 40 for slidably receiving seat belt webbing and a selected thermal graphic coupon 100. Upper housing portion 20 receives and supports control module 50, which controls the thermal heating process during use of the apparatus 10 and allows a user to set maximum temperature at various levels. Upper housing portion 20 supports control knob 60 which is used to release or apply pressure to the combined seat belt webbing and thermal graphic coupon 100 during use.

Lower housing portion 30 supports insulation sheet 38. Note that in a first embodiment, the lower housing portion 30 does not include a heating element. However, in other embodiments, the apparatus 10 can include heating elements in both the upper housing portion 20 and the lower housing portion 30 to change the thermal gradient applied to the seat belt webbing and thermal graphic coupon 100. The ability to change the thermal gradient allows further adaptation to changes in the seat belt webbing or materials of the thermal graphic coupon 100, changing the penetration and absorption into the seat belt webbing. This adaptability, supported by granular control of the heating protocol from the control module 50, allows the apparatus and method to be varied to accommodate a wide range of varying materials in both the seat belt webbing W and the thermal graphic coupon 100.

Figure 2:
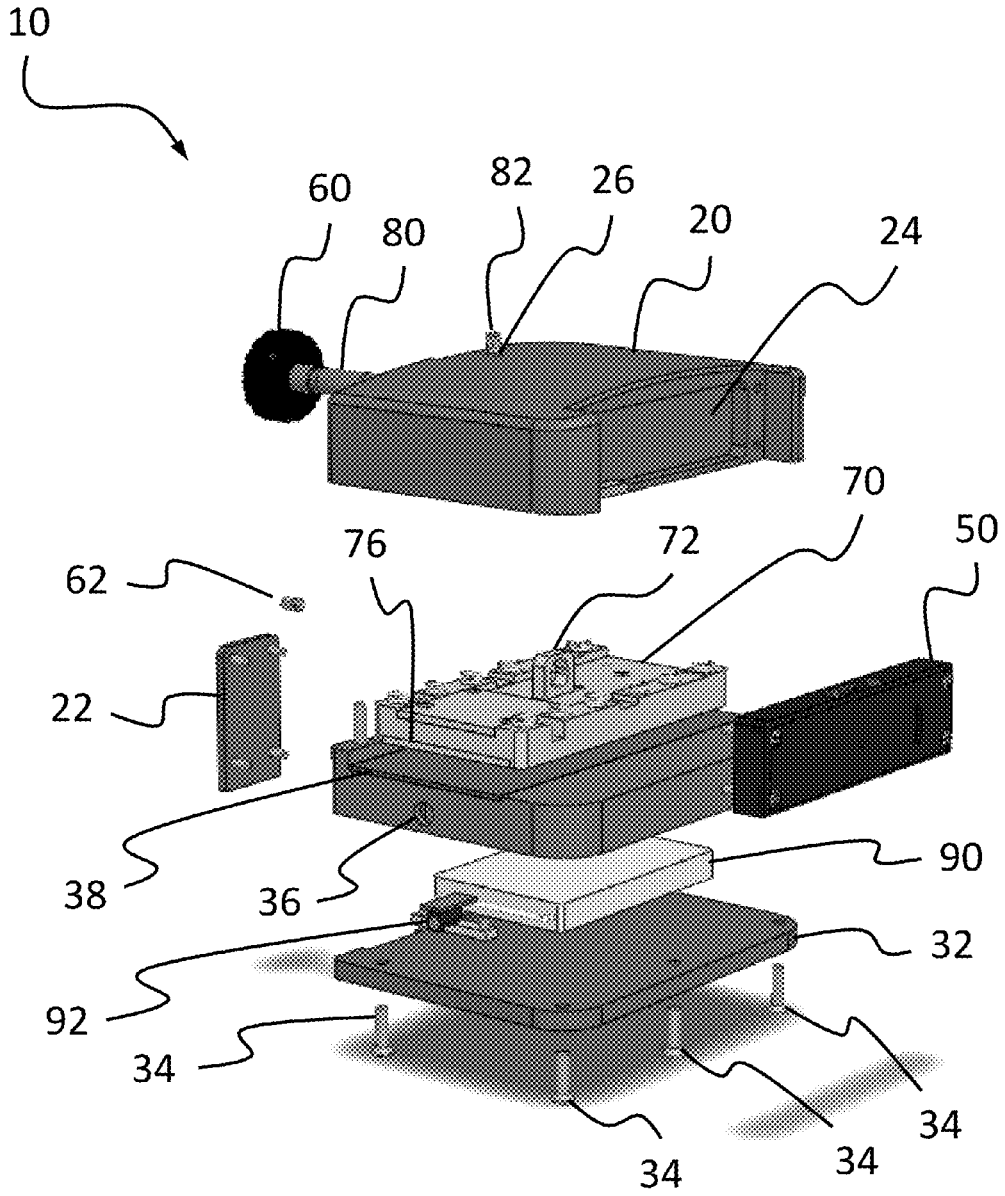
FIG. 2 is an exploded view of the apparatus.

Now, in further detail, additional components of the apparatus 10 are described. FIG. 2 is an exploded view of the apparatus 10. An upper housing portion 20 is configured to slidably receive clamping block 70. Clamping block 70 includes collar 72 sized to rotatably and slidably receive eccentric shaft 80. Eccentric shaft 80 is manipulated using control knob 60 to raise or lower clamping block 70 within upper housing 20.

One or more springs 74 are set in recesses within the clamping block 70 and determine the pressure P applied to the seat belt webbing W and graphic coupon 100 during the thermal application process. Control module 50 having on/off switch 52 and temperature control button 54 is affixed to a recess 24 in upper housing portion 20 using one or more screws 51. A rechargeable battery assembly 90 having charge coupling 92 is received within a recessed battery compartment 39 within the lower housing portion 30. Bottom plate 32 is affixed to lower housing portion 30 and upper housing portion 20 using screws 34. Access cover plate 22 is affixed to both the upper housing 20 and lower housing 30 using screws 23.

Eccentric shaft 80 passes through upper housing 20 and through the clamping block collar 72 such that an actuator 86 is positioned within the collar 72. Control knob 60 is fixably engaged with eccentric shaft 80 using setscrew 62. Eccentric shaft 80 has an actuator portion 86 which is positioned within collar 72 when assembled. Prior to rotation of control knob 60, the eccentric shaft 80 is positioned such that a low portion of the actuator 86 is within the collar 72 and the clamping block 70 is depressed by the springs 74 to rest and close upon lower insulation sheet 38.

To insert the webbing W and thermal graphic coupon 100 combination, a user rotates control knob 60 in either direction, which causes the eccentric shaft 80 to rotate and the higher portion of the actuator 86 engages the collar 72 and lifts the upper clamping block 70 and heating element 76 off the lower insulation sheet 38. The engagement slot 40 is then open and available to receive the seat belt webbing W and the thermal coupon 100 adhered to the seat belt webbing W. Once the webbing W and graphic thermal coupon 100 are properly received and positioned within the engagement slot 40 of the apparatus 10, the control knob 60 may be released and returns to a closed position driven by the springs 74. The pressure P applied to the webbing W and graphic coupon 100 is dependent on the spring constant and number of springs 74 installed in the apparatus 10 at assembly.

Figure 3:
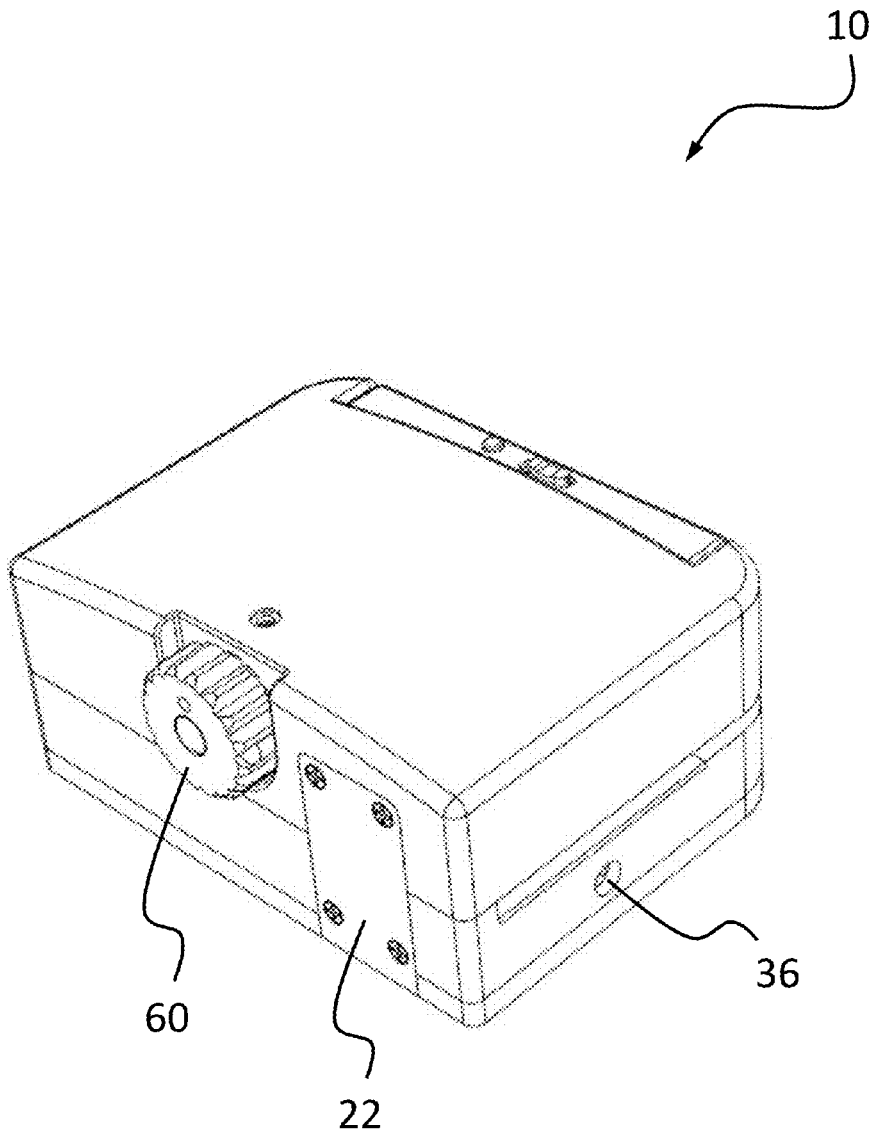
FIG. 3 is a second perspective view of the illustration in FIG. 1 taken from the opposite side of the apparatus.

Referring now to FIG. 3, there is shown a second perspective view of an embodiment of the apparatus from the opposite side of FIG. 1. This view highlights the side of the apparatus 10 including the control knob 60. Also illustrated in this view is a wire cover plate 22 providing access to wiring for the apparatus 10. Also shown is charge port 36 for receiving an input from an external battery charger that allows the apparatus 10 to be used portably by charging a battery that powers the apparatus 10.

Figure 4:
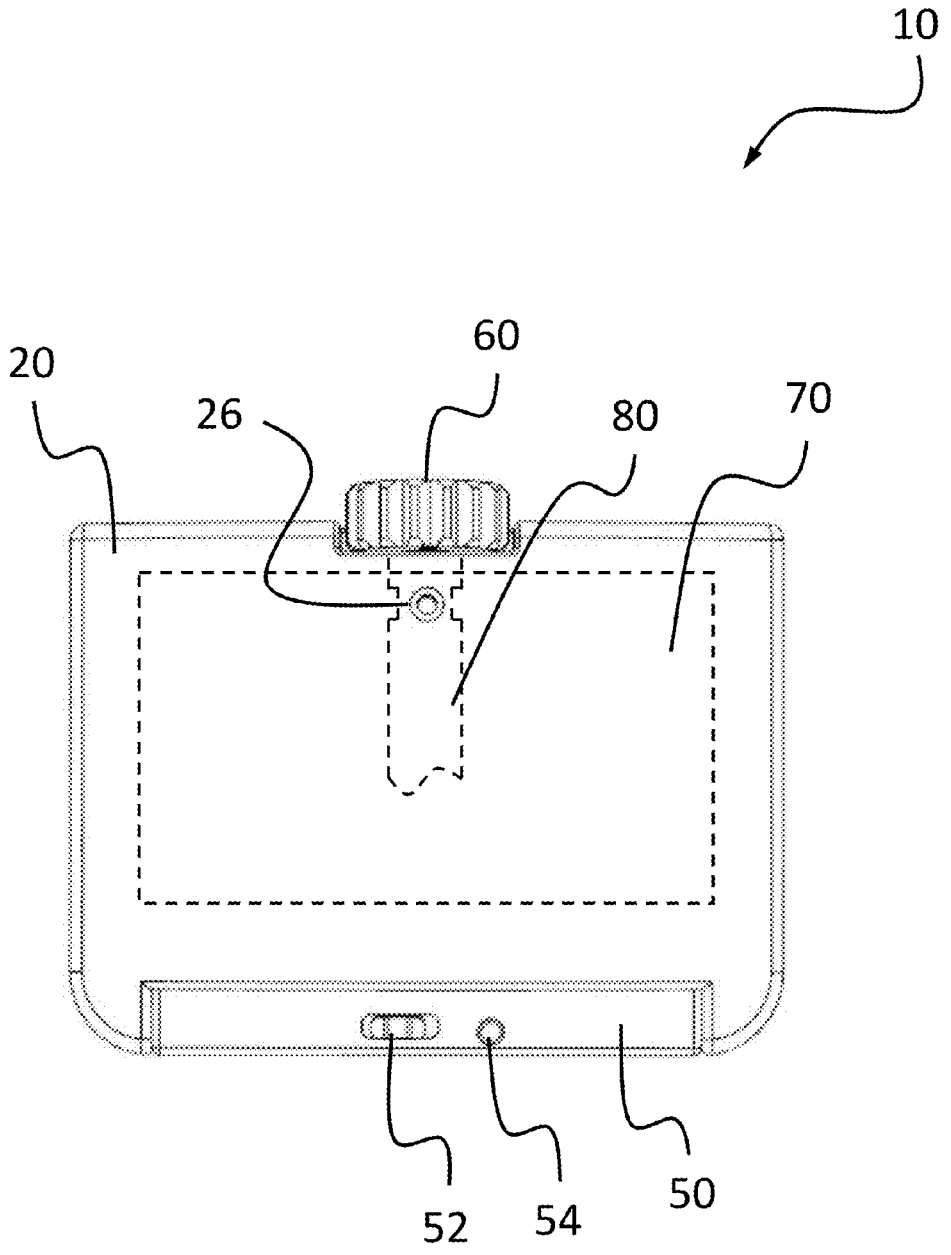
FIG. 4 is a top view of the apparatus.

Referring now to FIG. 4, a top view of the apparatus 10 is shown. The upper housing portion 20 houses the control module 50. The control module 50 includes a switch 52 for turning the apparatus 10 on and off. It also includes a button 54 that is pressed to change the operating temperature of the apparatus 10. In one aspect, the button 54 actuates three different temperature levels at one of 280 degrees, 350 degrees, or 410 degrees Fahrenheit. Also shown is a hole 26 in upper housing 20, which receives a retention screw 82 to retain eccentric shaft 80 within upper housing 20.

The control knob 60 is attached to eccentric shaft 80 via setscrew 62. The control knob 60 is rotated to rotate eccentric shaft 80, which causes clamping block 70 to rise to open engagement slot 40, allowing insertion of the seat belt webbing and thermal graphic coupon 100. Once control knob 60 is released, the webbing and graphic coupon 100 are clamped within the engagement slot 40 at a predetermined pressure P. The predetermined pressure P can be adjusted by changing the number of springs 74 used or changing the spring constant.

The pressure applied through the upper clamping block 70 is determined by the number of springs 74 and the spring constant of each spring 74. In use and operation, the clamping block 70 remains in a closed position to keep the lower insulating sheet 38 and upper heating surface 76 clean and avoid unnecessary contamination. Control knob 60 is rotated to raise the clamping block 70 to allow the webbing to be slid within the engagement slot 40 along with the thermal graphic transfer coupon 100.

Figure 5A:
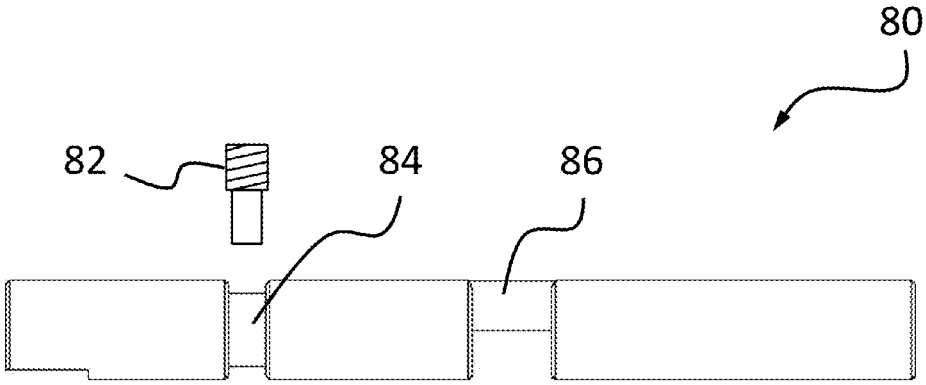
FIGS. 5A and 5B are side views of the eccentric shaft in a high and low position, according to the invention.
Figure 5B:
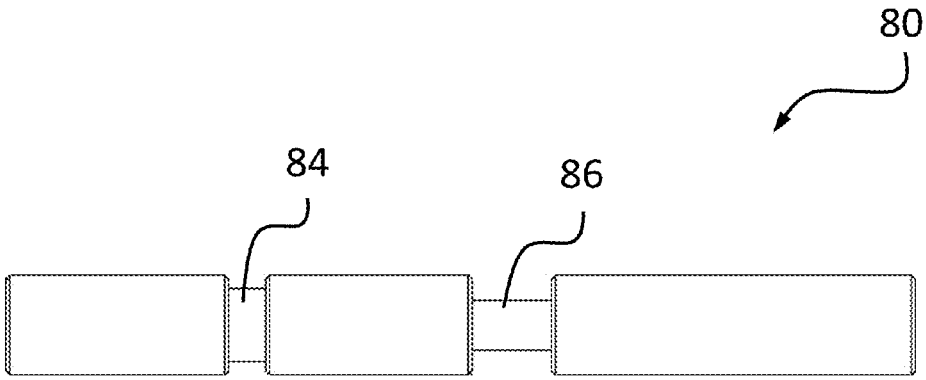

Referring now to FIGS. 5A and 5B, a side view of the eccentric shaft 80 is shown. In FIG. 5A, the eccentric shaft 80 is rotated to a high position wherein the clamping block 70 is raised and the engagement slot 40 is open. In FIG. 5B, the eccentric shaft 80 is rotated to a low position wherein the clamping block 70 is lowered and the engagement slot 40 is closed and the clamping block 70 is able to secure the webbing W and thermal graphic coupon 100 within the engagement slot 40. The eccentric shaft 80 is rotatably secured within the upper housing 20 using retention screw 82 which is driven to engage within a retention groove 84. The eccentric shaft 80 also includes an actuator 86 which engages the collar 72 to either lower or raise the clamping block 70.

Figure 6:
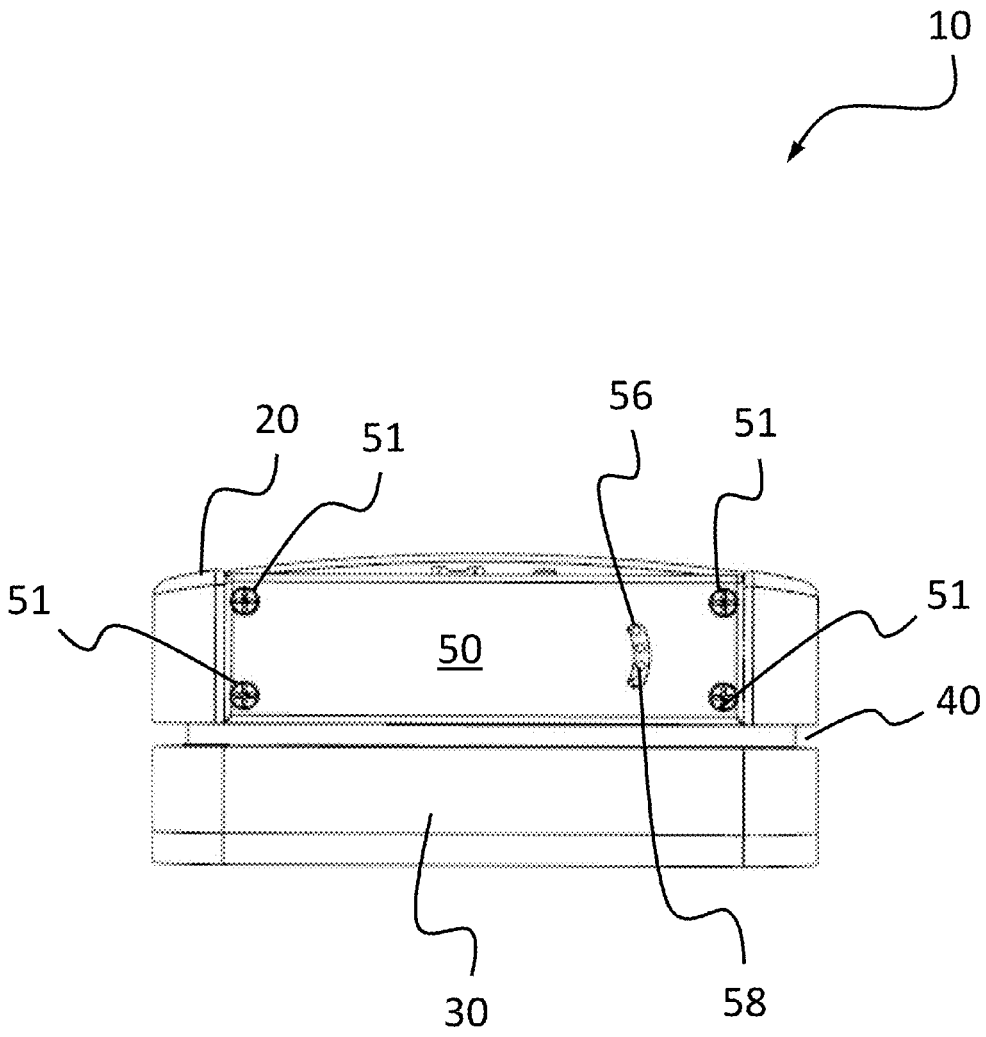
FIG. 6 is a front view of the apparatus.

Referring now to FIG. 6, a front view of the apparatus 10 is shown. This front view illustrates the upper housing portion 20, which includes the control module 50. Also shown is the lower housing portion 30. Upper housing portion 20 and lower housing portion 30 are fixably assembled to form engagement slot 40 for receiving the webbing W with the affixed graphic coupon 100 properly positioned on the webbing W. In one embodiment, control module 50 is positioned within a recess 24 in the upper housing portion 20 fixably attached to upper housing portion 20 via four screws 51.

Control module 50 includes indicator 56 comprised of three LEDs 58 which indicate the various temperature levels to be applied during the thermal application process. In one aspect, when the lower LED 58 is lit, the apparatus 10 is set to heat to a temperature of 280 degrees Fahrenheit. When the middle LED 58 is lit, the apparatus is set to heat to a temperature of 350 degrees Fahrenheit. When the upper LED 58 is lit, the apparatus is set to heat to a temperature of 410 degrees Fahrenheit. In separate aspects, the control module 50 may have only one LED 58 indicating that the apparatus 10 is operating. Alternatively, the apparatus 10 could likewise have a temperature control means that allows more granular control of the heating temperature.

Figure 7:
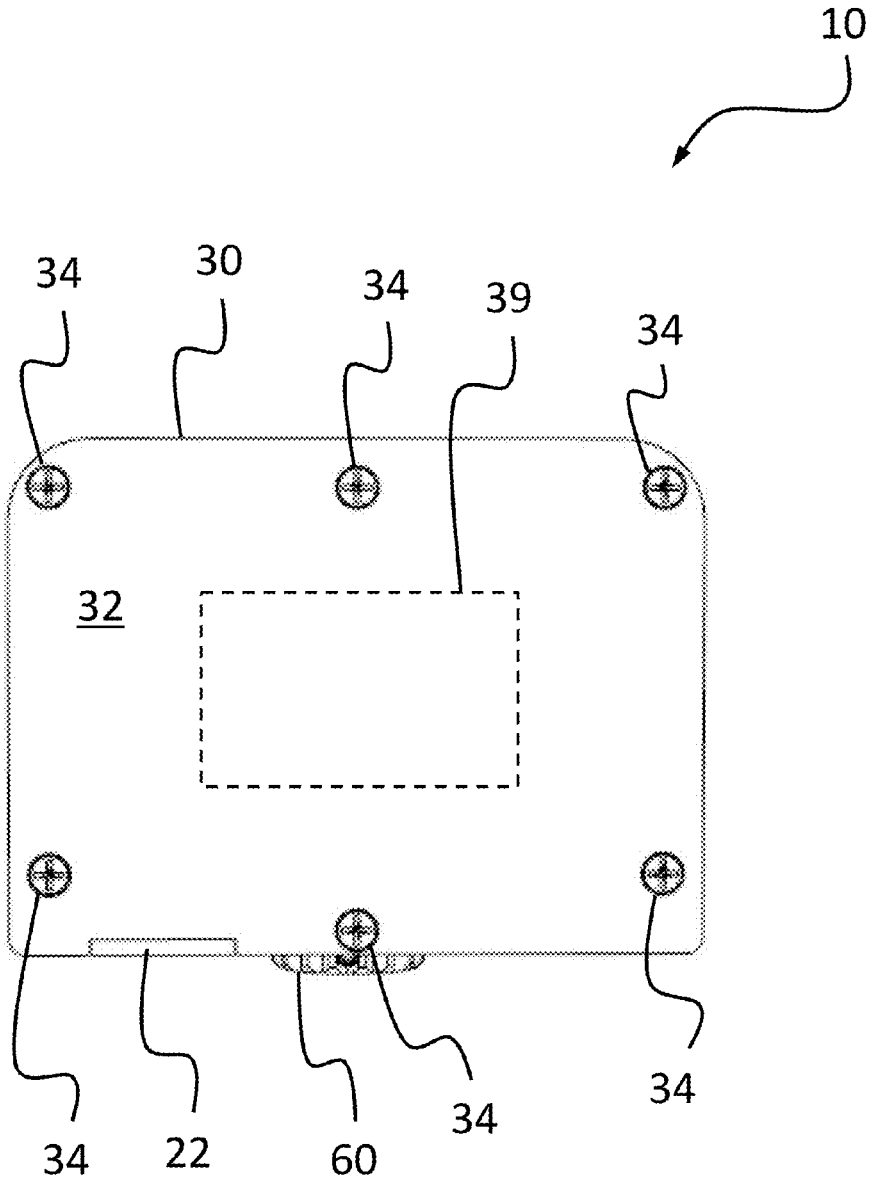
FIG. 7 is a bottom view of the apparatus.

Referring now to FIG. 7, a bottom view of the apparatus 10 is provided. The lower housing portion 30 includes a bottom cover plate 32 removably attached using six screws 34. The bottom plate 32 can be removed to access a battery compartment 39 for battery 90 replacement.

Figure 8:
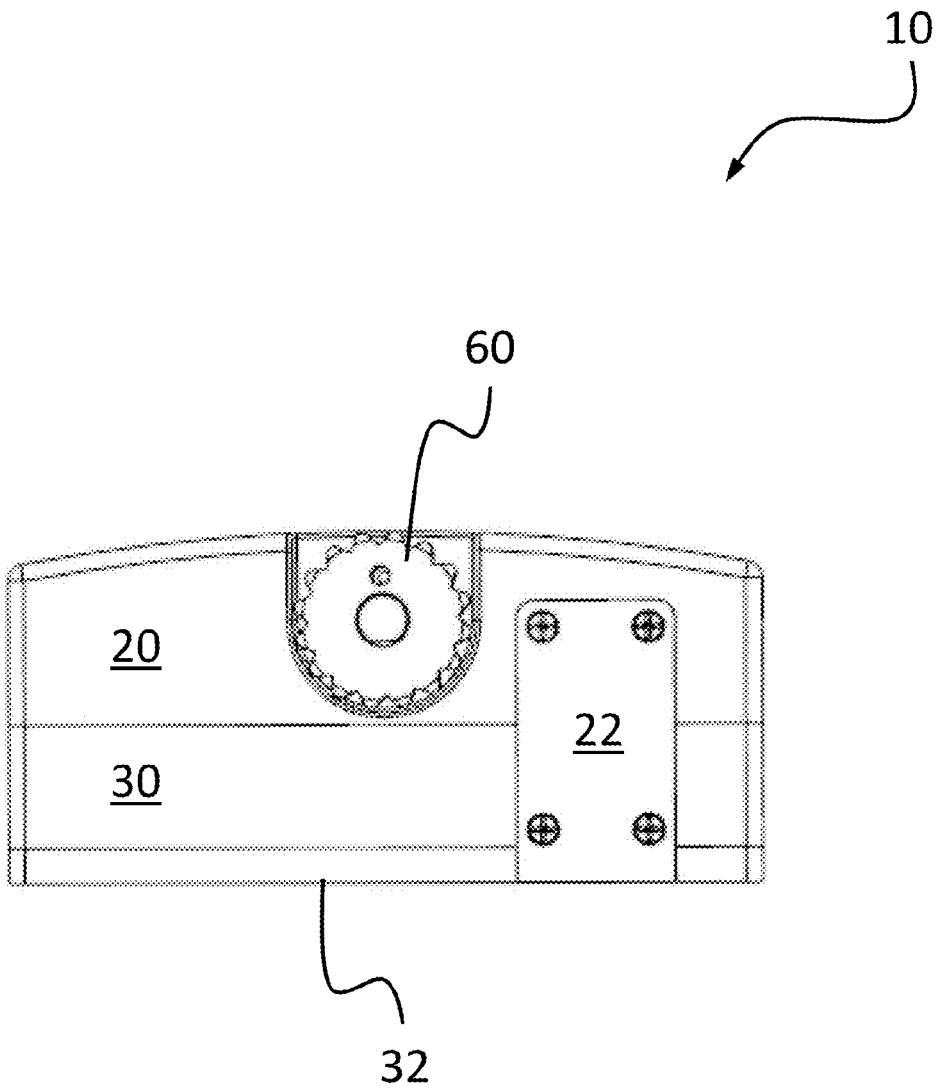
FIG. 8 is a rear view of the apparatus.

Referring now to FIG. 8, a rear side view of the apparatus 10 is shown. Control knob 60 attached to eccentric shaft 80 extends from upper housing portion 20. Wire cover plate 22 provides internal access to wiring for the apparatus 10. Upper housing portion 20 and lower housing portion 30 are fixably engaged. Bottom plate 32 forms the base of the apparatus 10. Bottom plate 32 may be removed to allow access to battery compartment 39.

Figure 9A:
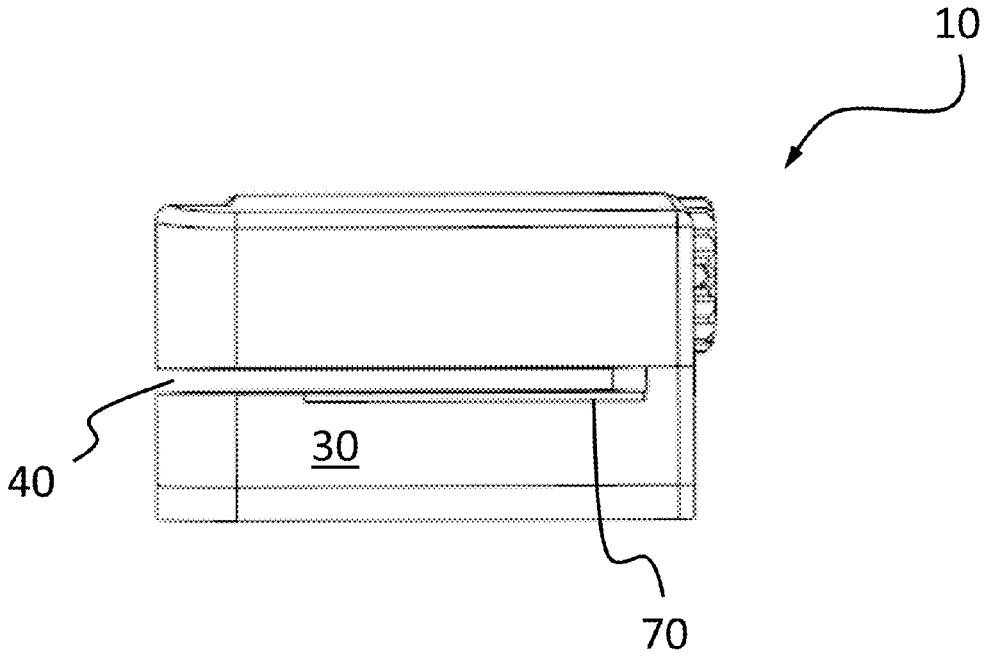
FIG. 9A is a first side view of the apparatus.
Figure 9B:
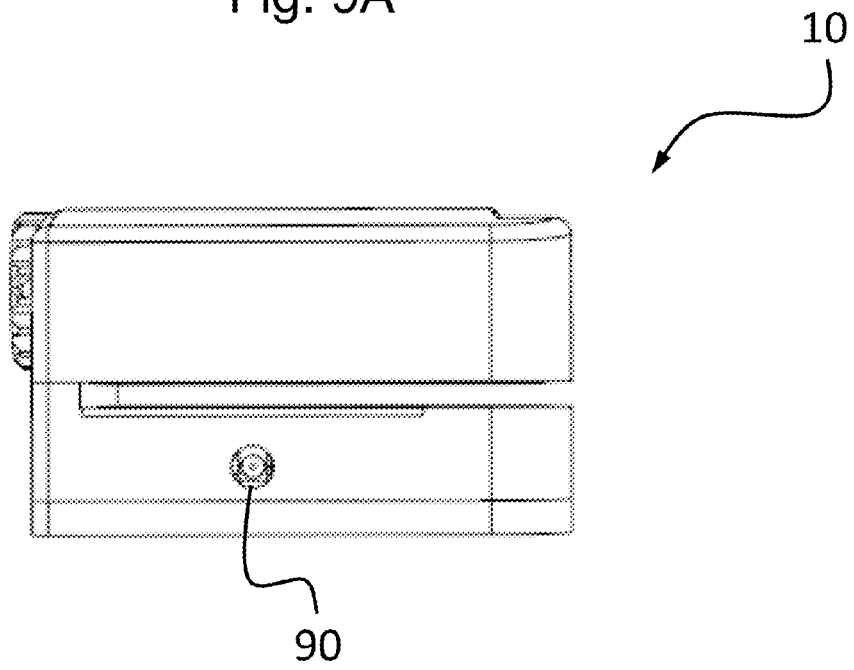
FIG. 9B is a second side view of the apparatus.

Referring now to FIGS. 8A and 8B, two end-views of the apparatus 10 are shown. In FIG. 9A, insulating platen 38 is set in a recess in the lower housing portion 30, positioned in the lower portion of the engagement slot 40. In FIG. 9B, charge port 36 for charging plug 92 is designed to accept a plug from an external battery charger (not shown).

Figure 10:
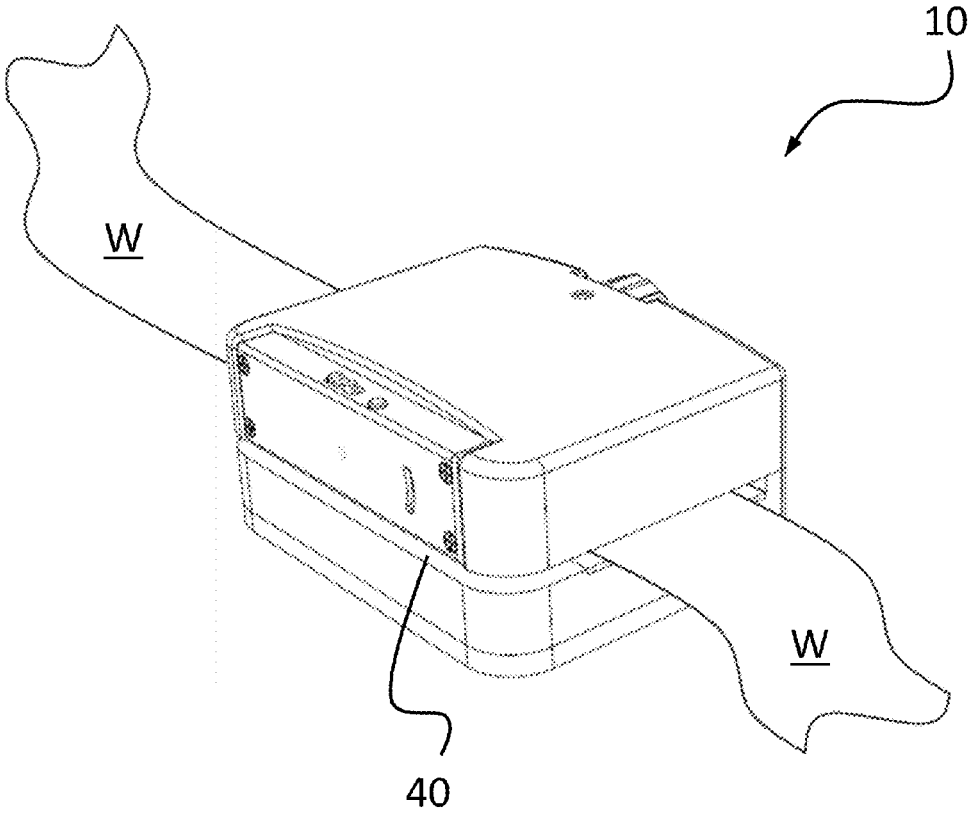
FIG. 10 is a perspective view of the device in use with an illustration of the manner in which the seat belt webbing and graphic are inserted into the apparatus, showing one way in which the apparatus of FIG. 1 may be used.
Figure 11:
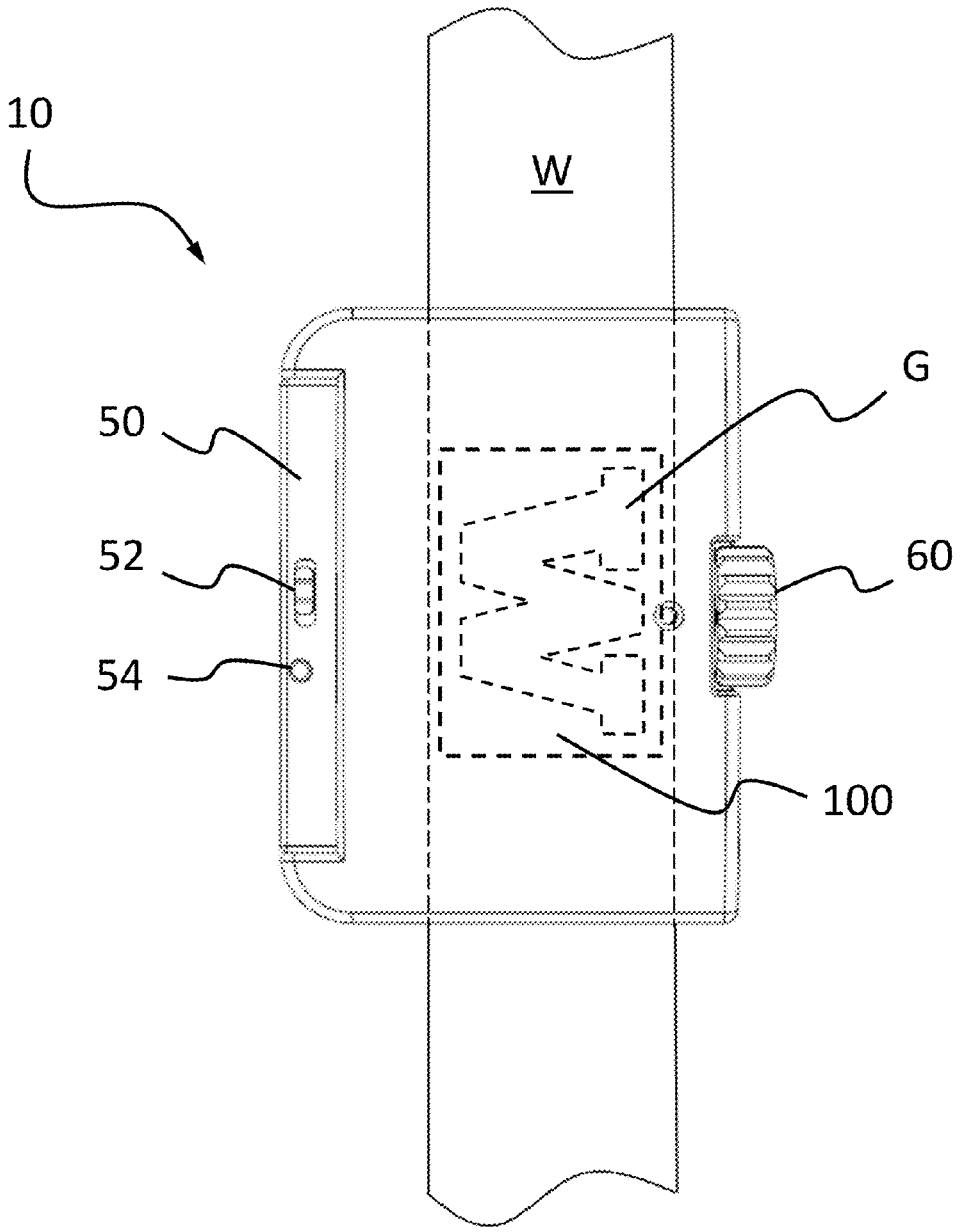
FIG. 11 is a top view of the apparatus as shown in FIG. 9.

Referring now to FIG. 9, an illustration of the apparatus 10 engaged with webbing W in engagement slot 40 is shown. Note that, in use, the location of the apparatus 10 along the webbing W may be adjusted to ensure that the thermal graphic transfer coupon 100 is properly located on the seat belt webbing W at the desired location for viewing when the seat belt is in use, and/or when the seat belt is not in use and fully retracted. Note that the apparatus and method according to the invention allows the application of one or more graphics G along the length of the seat belt. In particular, a separate thermal graphic transfer coupon 100 may be applied to the seat belt webbing W at another location such that the desired graphic G is displayed to other occupants when the particular seat belt is not in use by an occupant, and instead, fully retracted to its resting position Referring now to FIG. 10, a top view of the apparatus 10 is shown with the seat belt webbing W and thermal graphic transfer coupon 100 clamped within the engagement slot 40 of the apparatus 10. Thus engaged, the apparatus 10 can be triggered by pushing the on switch 52 to thermally heat the thermal graphic transfer coupon 100 and the seat belt webbing W to cause the graphic transfer membrane 120 to transfer the graphic G to the webbing W.

The following steps represent the use and operation of the apparatus 10 for thermally applying the thermal graphic coupon 100 to the seat belt webbing W to produce a desired applied graphic G. First, an appropriately sized thermal graphic transfer coupon 100, having the desired image or graphic G, is selected for use. The thermal graphic transfer coupon 100 is sized to be no wider than the width of the seat belt webbing W and no longer than the length of the heating platen 76 in the engagement slot 40 of the apparatus 10.

In one aspect, the apparatus 10 may be operated with the intended or representative occupant actually sitting in the seat with the seat belt fully engaged. Next, the graphic coupon 100 is applied at a desired position on the seat belt. To apply the graphic G, the adhesive protective membrane 130 is removed from the bottom of the thermal graphic transfer coupon 100. In one aspect, the portion removed is identified by the number 1 and a message that indicates that the sheet should be first removed. Once the protective sheet 130 is removed, the thermal graphic transfer coupon 100 is applied to the seat belt in the desired location and position using the sticky, adhesive film 125 exposed by the removal of the adhesive protective sheet 130. The adhesive film 125 maintains the position of the thermal graphic transfer coupon 100 on the seat belt webbing W during thermal and pressure transfer of the graphic G.

Next, a user rotates the control knob 60 to raise the clamping block 70 to open the engagement slot 40. Then, the apparatus 10 is slid onto the webbing W where the graphic coupon 100 has been positioned. Once the webbing W and the graphic coupon 100 are slidably received within the engagement slot 40, the user is able to adjust the position of the apparatus 10 and move the apparatus 10 along the seat belt webbing W until the apparatus 10 is optimally located above the graphic coupon 100. As indicated, the apparatus 10 may be used while an occupant is seated in the vehicle seat with the seat belt engaged. With the use of the adhesively applied thermal graphic transfer coupon 100, the position of the graphic 100 may be adjusted to ensure that the placement of the graphic G is customized to the size and seating position of an occupant.

Figure 12A:
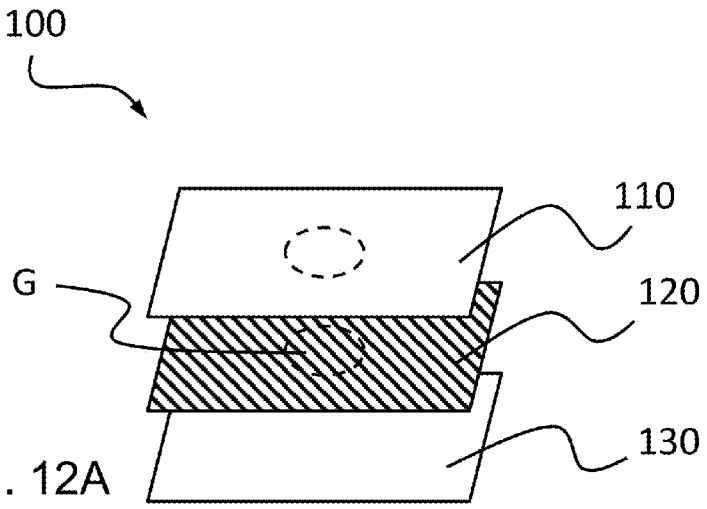
FIGS. 12A-12C are illustrations of the thermal graphic coupon and release sheet, according to an embodiment of the invention.
Figure 12B:
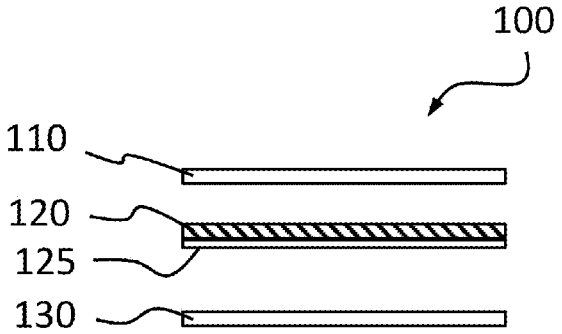

Referring to FIGS. 12A and 12B, a simplified illustration of a thermal graphic transfer coupon 100 according to the method and operation of the apparatus described herein is shown. The thermal graphic coupon 100 is comprised of three primary layers or sheets: a heating membrane 110, over a graphic transfer membrane 120 and an adhesive protective membrane 130 covering the back adhesion surface of the graphic transfer membrane 120. The adhesive protective membrane 130 protects the bottom of the graphic transfer membrane 120 until ready for use; the back of the graphic transfer membrane 120 includes a film of sticky adhesive 125 for positioning the thermal graphic transfer coupon 100 at a desired location on the seat belt webbing W. After the thermal graphic transfer coupon 100 has been thermally applied to the seat belt webbing W, the heating membrane 110 is peeled off the graphic transfer membrane 120, leaving the graphic G. The graphic G remains semi-permanently affixed to the seat belt webbing W.

Figure 12C:
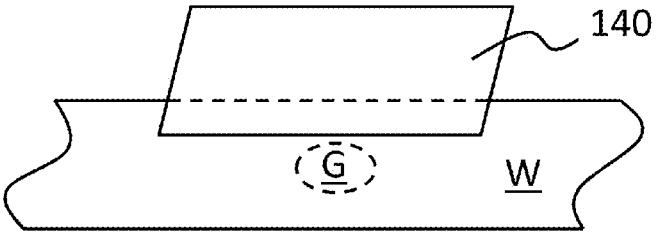

Referring now to FIG. 12C, in another aspect, the method for removing the thermally applied graphic is described. When one wishes to remove the graphic transfer membrane 120, the process is reversed. For removal, a separate release sheet 140 having an adhesive surface film is positioned over the graphic G that was previously semi-permanently applied to the seat belt webbing W. The seat belt webbing W and separate release sheet 140 are then simultaneously slidably engaged within the engagement slot 40 of the apparatus 10. The control knob 60 is released and pressure applied to the combination of the release sheet 140 placed over the graphic G on the seat belt webbing W. The apparatus 10 is then switched on to once again heat the target area on the seat belt webbing W. Note that the release sheet 140 also serves as a protective layer to avoid damaging the heating surface 76. As the graphic G and release sheet 140 are heated, the molecules and fibers which comprise the graphic transfer membrane 120 are preferentially removed from the seat belt webbing W to adhere to the release sheet 140.

If a first removal process does not completely remove the graphic G, the removal process can be repeated until the graphic G has been satisfactorily removed and the seat belt webbing W is returned to a substantially original condition.

Note that the graphic release sheet 140 is configured to be thermally appropriate to the melting point of the applied graphic transfer membrane 120. Hence, the release sheet 140 is comprised of material that has a higher melting point then the material associated with the applied graphic transfer membrane 120. Likewise, both the graphic release sheet 140 and the graphic transfer membrane 120 are operable in a temperature range that is sufficiently low to avoid any damage to the material of the seat belt webbing W.

In particular, in one embodiment, the apparatus 10 can be set for one of three maximum heating temperatures. In a further embodiment, the apparatus 10 includes a heating controller that allows the temperature to be controlled in a more granular method to optimize removal of the graphic G from the seat belt webbing W while avoiding a temperature that might impair the seat belt webbing W. Seat belt webbing W is typically made from materials such as polyamide, polyester, cotton, and other fabrics.

Figure 13:
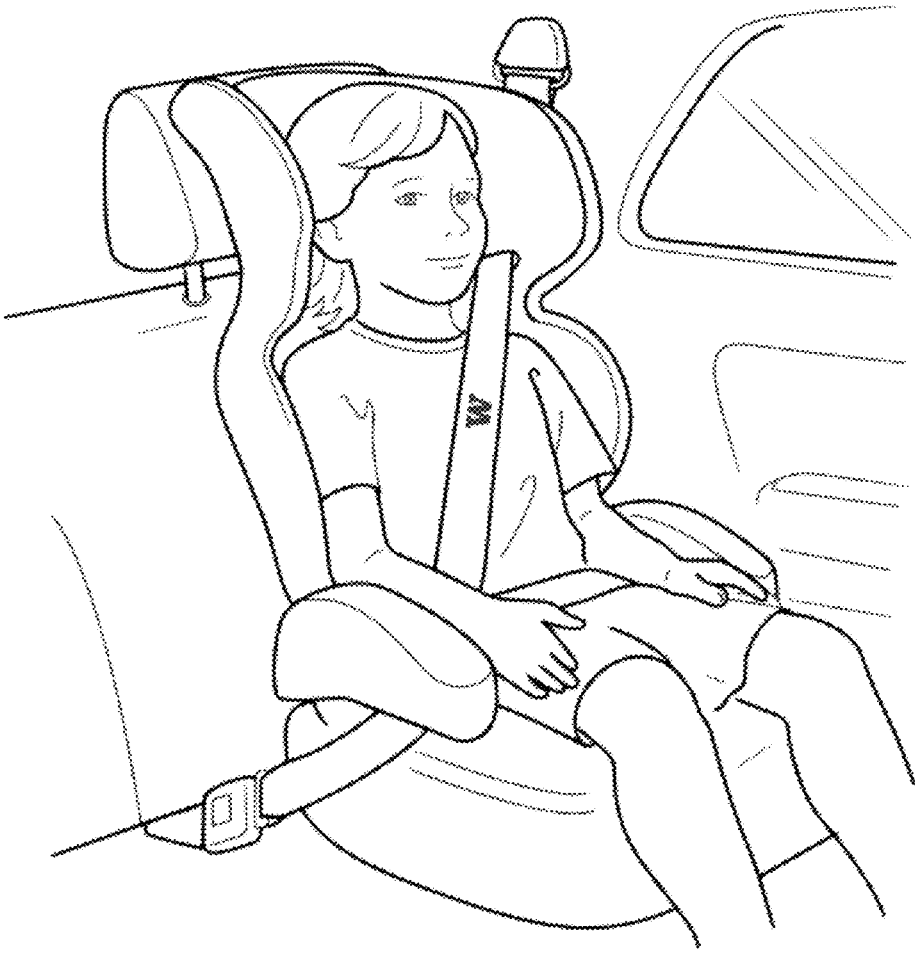
FIG. 13 is a view of a child buckled into her car seat with a graphic applied in an optimal position, according to an embodiment of the invention.

Referring now to FIG. 13, an illustration of the result of the use of the apparatus 10 is shown. Note that the graphic G, shown herein as a stylized letter "W", has been optimally positioned on the seat belt webbing W in relation to the occupant's size and seating position. This optimal positioning is enabled via the use of the adhesively applied graphic coupon 100, the ability of the apparatus 10 to be used while an occupant is actually sitting in a seat with the seat belt engaged, and the ability of the apparatus 10 to be repositioned along the length of the seat belt webbing W prior to use. Because of these features, the graphic G may be applied to the seat belt webbing W without having to remove the seat belt from the vehicle. Note also that this features also allows a graphic to be properly positioned on the seat belt webbing W even when the vehicle occupant may be seated in a booster seat as shown in the illustration.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. An apparatus for thermally applying and removing a graphic to seat belt webbing, the apparatus comprising:

a) a thermal graphic coupon;

b) a release sheet;

c) a housing comprised of an upper housing portion and a lower housing portion, thereby forming an engagement slot;

d) the engagement slot for receiving the seat belt webbing and thermal graphic coupon;

e) a clamping block having a collar to slidably receive a rotatable eccentric shaft;

f) a control module;

g) a heating platen having a heating element for applying heat;

h) an insulating sheet;

i) a portable power source;

j) an on-off switch;

k) a temperature control button;

l) a temperature setting indicator;

m) one or more springs for applying a downward force on the heating element to releasably engage the seat belt webbing and thermal graphic coupon within the engagement slot of the apparatus;

n) a control knob connected to the rotatable eccentric shaft housed within the upper housing portion of the apparatus;

o) the rotatable eccentric shaft having a high and low portion;

p) wherein rotation of the control knob causes rotation of the eccentric shaft;

q) wherein rotation of the eccentric shaft to a high position causes the high portion to raise the heating platen off the insulating sheet, thereby compressing one or more springs recessed between said heating platen and said upper housing portion, and, opening the engagement slot to slidably receive the seat belt webbing and the applied thermal graphic coupon within the engagement slot; and r) wherein rotation of the control knob and the eccentric shaft in an opposite direction to a low position causes the heating platen to descend and compress against the insulating sheet and lower housing portion, applying a downward pressure determined by the spring force against any contents present within the engagement slot.

2. The apparatus according to claim 1, wherein the thermal graphic coupon further comprises:

a) a heating layer;

b) a graphic membrane having a graphic image;

c) a protective layer, wherein said protective layer protects an adhesive layer on an underside of the graphic membrane;

d) the adhesive layer used to position the thermal graphic coupon in a desired position on the seat belt webbing before application of thermal energy to the coupon; and e) the heating layer used to provide a protective barrier between the graphic membrane and a heating platen during heating, and the heating layer being peeled off the graphic membrane after heating to fully expose the graphic image applied to the seat belt webbing.

3. The apparatus according to claim 1, characterized in that the heating element has a controllable heating rate.

4. The apparatus according to claim 1 wherein the portable power source is selected from the group of a replaceable battery, a rechargeable battery, a plug and cord for connection into a cigarette lighter of a vehicle, a plug and cord for connection into a power outlet of a vehicle, a plug and cord for connection into an external power outlet, and a combination of the rechargeable battery with any of the power sources associated with connection via a plug and cord.

5. A method for thermally applying and removing a graphic to seat-belt webbing using the apparatus of claim 1, comprising the steps of:

a) adhesively applying the thermal graphic coupon to the seat belt webbing in a desired position;

b) rotating the control knob of the apparatus for rotating the eccentric shaft to raise the heating platen a sufficient distance to open the engagement slot of the apparatus;

c) inserting the seat belt webbing and thermal graphic coupon in the engagement slot of the apparatus;

d) releasing the control knob to allow the one or more springs to drive the heating platen and clamping block downward to compress against the lower portion of the housing of the apparatus, thereby clamping the webbing and thermal graphic coupon in the engagement slot;

e) moving the on-off switch to ON to begin heating the heating platen;

f) activating the temperature control button to select a desired heating temperature;

g) allowing the heating platen to heat to the desired temperature as indicated by the temperature setting indicator;

h) turning the on-off switch to OFF to cease heating once the temperature setting indicator indicates the desired temperature has been achieved;

i) rotating the control knob to raise the heating platen and clamping block upward to remove the pressure in the engagement slot on the webbing and thermal coupon;

j) removing the webbing and thermal graphic coupon from the engagement slot of the apparatus;

k) peeling the heating membrane off the thermal graphic coupon heretofore thermally applied to the seat belt webbing to expose the graphic membrane and the associated graphic image;

l) allowing the graphic membrane and seat-belt webbing to return to ambient temperature before use;

m) at such time as removal of the graphic membrane is desired, adhesively applying the release sheet having an adhesive surface film in position over the graphic membrane previously thermally applied to the seat belt webbing;

n) rotating the control knob of the apparatus to rotate the eccentric shaft to raise the heating platen to open the engagement slot of the apparatus;

o) inserting the seat belt webbing and release sheet in the engagement slot of the apparatus;

p) releasing the control knob to allow the one or more springs to drive the heating platen downward to compress against the lower portion of the housing of the apparatus, thereby clamping the seat belt webbing and release sheet in the engagement slot;

q) turning the on-off switch to ON to begin heating the heating platen;

r) activating the temperature control button to select a desired heating temperature;

s) allowing the heating platen to heat to the desired temperature as indicated by the temperature setting indicator;

t) turning the on-off switch to OFF to cease heating once the temperature setting indicator indicates the desired temperature has been achieved;

u) rotating the control knob to raise the heating platen upward to remove the pressure in the engagement slot on the webbing and release sheet;

v) removing the webbing and release sheet from the engagement slot of the apparatus;

w) peeling the release sheet with the absorbed graphic membrane from the seat belt webbing;

x) examining the seat belt webbing to confirm that the graphic membrane has been substantially removed from the seat belt webbing;

y) if not substantially removed, allowing the graphic membrane and seat-belt webbing to return to ambient temperature; and z) repeating steps (m) through (y) until the graphic membrane has been substantially removed from the seat belt webbing.

6. The method of claim 5 further including the steps of:

a) prior to adhesively placing the thermal graphic coupon, placing an occupant in a seat secured by the seat belt webbing;

b) selecting the desired position for placement of the thermal graphic coupon based upon positioning of the occupant and extension of the seat belt while the occupant is actually secured in the seat using the seat belt; and c) proceeding to apply the thermal graphic coupon while the occupant remains securely seated in the seat, thereby ensuring that the thermal graphic coupon is placed in the desired position for viewing while the occupant is seated and using the seat belt.

* * * * *